US007306229B2

(12) United States Patent
Rolfe

(10) Patent No.: US 7,306,229 B2
(45) Date of Patent: Dec. 11, 2007

(54) FIREARM TARGET ASSEMBLY

(76) Inventor: Richard A. Rolfe, 309 Elm St., Standish, MI (US) 48658

( * ) Notice: Subject to any disclaimer, the term of this patent is extended or adjusted under 35 U.S.C. 154(b) by 64 days.

(21) Appl. No.: 11/300,528

(22) Filed: Dec. 14, 2005

(65) Prior Publication Data

US 2006/0125185 A1 Jun. 15, 2006

Related U.S. Application Data

(60) Provisional application No. 60/635,860, filed on Dec. 14, 2004.

(51) Int. Cl.
*F41J 7/04* (2006.01)

(52) U.S. Cl. ..... 273/391

(58) Field of Classification Search ..... 273/388–392
See application file for complete search history.

(56) References Cited

U.S. PATENT DOCUMENTS

| | | | | | |
|---|---|---|---|---|---|
| 926,955 | A | | 7/1909 | Muller | |
| 1,348,540 | A | * | 8/1920 | Briggs | 273/388 |
| 1,841,851 | A | | 1/1932 | Semple | |
| 3,411,784 | A | | 11/1968 | Lawrence | |
| 3,720,413 | A | | 3/1973 | Ready | |
| 4,550,918 | A | * | 11/1985 | Motsenbocker | 273/385 |
| 4,588,194 | A | | 5/1986 | Steidle et al. | |
| 4,726,593 | A | | 2/1988 | Wade | |
| 4,739,996 | A | | 4/1988 | Vedder | |
| 4,917,388 | A | | 4/1990 | Marquardt | |
| 4,949,980 | A | * | 8/1990 | Hoy | 273/391 |
| 4,979,752 | A | | 12/1990 | Fosseen | |
| 5,232,227 | A | | 8/1993 | Bateman | |
| 5,263,722 | A | | 11/1993 | Rosellen | |
| 5,342,062 | A | | 8/1994 | Lance | |
| 5,346,226 | A | | 9/1994 | Block | |
| 5,603,505 | A | | 2/1997 | Acock | |
| 5,647,596 | A | | 7/1997 | Rail | |
| 5,676,378 | A | | 10/1997 | West | |
| 6,199,866 | B1 | | 3/2001 | Ricco, Sr. | |
| 6,347,798 | B1 | | 2/2002 | Quiring et al. | |
| 6,398,215 | B1 | | 6/2002 | Carroll | |
| 6,491,303 | B1 | | 12/2002 | Huston | |
| 6,502,820 | B2 | | 1/2003 | Stifko | |
| 6,779,797 | B1 | * | 8/2004 | Chou | 273/391 |
| 6,896,267 | B1 | * | 5/2005 | Le Anna | 273/391 |
| 2004/0201172 | A1 | * | 10/2004 | Goldsmith | 273/391 |

* cited by examiner

*Primary Examiner*—Mark S Graham
(74) *Attorney, Agent, or Firm*—Farris Law, P.C.; Robert L. Farris

(57) ABSTRACT

The firearm target assembly includes a target mount, an upper target assembly, and a lower target assembly. The target mount is clamped to a support beam. Two vertical spaced apart ears extend rearward from the rear of the mount. An upper target assembly and a lower target assembly both have a flat metal disk attached to a shank with a shank free end. The free end of the upper shank is pivotally attached to the ears for pivotal movement about an upper horizontal axis. The free end of the lower shank is pivotally attached to the ears for pivotal movement about a lower horizontal axis. The upper target moves from a vertical position to a horizontal position upon being struck by a bullet and forces the lower target to a ready position. The lower target returns the upper target to a ready position upon being struck by a bullet.

6 Claims, 5 Drawing Sheets

FIREARM TARGET ASSEMBLY

REFERENCE TO CO-PENDING APPLICATION

This application claims the benefit of U.S. Provisional Patent Application Ser. No. 60/635,860, filed on Dec. 14, 2004.

TECHNICAL FIELD

The firearm target system includes two metal targets, pivotally attached to a common metal frame, each of which is moved from a vertical ready position by the impact of a projectile and simultaneously moves the other target to a ready position, and wherein one target is free to pivot relative to the frame while the other target remains stationary.

BACKGROUND OF THE INVENTION

Cardboard or paper targets are employed when a shooter desires to determine where each round strikes the target relative to a target center. These targets are used where each round is to be scored in competition. These targets are also used where it is desired to adjust firearm sights.

Cardboard or paper targets have a number of drawbacks. Generally the shooter can not tell where a target was hit without moving close to the target or using a telescope or other optical device. With some target systems the target is moved toward a firing line. With other target systems the shooter moves toward the target. Moving the target toward the firing line requires a target support system that can move the target. Target moving systems are expensive, require maintenance, and take time to operate. Permitting a shooter to move forward to inspect a target requires time and requires control of the firing line if there is more than one shooter on the firing line.

Shooters may desire to know only if a target is hit or missed after the sights are adjusted. Target systems have been developed which move a target from a vertical position to a horizontal position after the target is hit. Target systems are also available which rotate a target about a vertical axis between a position facing a firing line and a position facing ninety degrees to one side or the other of the shooters line of sight. Power is generally required from an outside source to pivot targets about an axis.

Two steel target plates have been pivotally attached to a beam with one target plate to the rear of the other target plate. A control link pivotally attached to both target plates raises one target plate to a generally vertical position when the other target plate is lowered from a generally vertical position. With this system, a projectile strikes the target plate that is in a generally vertical position causing the struck target plate to pivot from the generally vertical position and simultaneously raise the target plate that was not struck by the projectile to be raised to the generally vertical position. The target plate that was not struck by the first projectile is then in a generally vertical position to be hit by a second projectile. The bolts that pivotally attach the target plates to the beam and the bolts that pivotally attach the control link to both target plates are loosened or tightened to obtain the desired functioning of the target system.

SUMMARY OF THE INVENTION

The firearm target assembly includes an elongated target mount with a top frame wall, a front frame wall integral with the top frame wall and a rear frame wall integral with the top frame wall and a channel adapted to receive horizontal target supports. A pair of threaded fasteners mounted in the rear frame wall to clamp the elongated target mount to a target support. A first vertical ear is fixed to the rear frame and extends rearward from the rear frame wall. A second vertical ear is parallel to and spaced from the first vertical ear. An upper target includes an upper flat metal disk with an upper disk face and an upper disk back. An upper shank is secured to the upper disk back of the upper flat metal disk. The upper shank extends radially from the upper flat metal disk to an upper shank free end. An upper target pivot pin extends through a first upper pin bore through the first vertical ear, through the upper shank free end and through a second upper pin bore through the second vertical ear. The upper target pivot pin supports the upper target for pivotal movement about an upper horizontal axis between an upper target ready position in which the upper disk face is substantially vertical and a front upper stop surface on the upper shank engages a mount stop surface on the elongated target mount and a generally horizontal position down range from the elongated target mount. A lower target includes a lower flat metal disk with a lower disk face and a lower disk back. A lower shank is secured to the lower disk back and extends radially from the lower flat metal disk to a lower shank free end. A lower target pivot pin extends though a first lower pin bore through the first vertical ear, through the lower shank free end and through a second lower pin bore through the second vertical ear. The lower target pivot pin supports the lower target for pivotal movement about a lower horizontal axis that is parallel to the upper horizontal axis and below the upper horizontal axis. The lower target is moved by gravity to a lower target rest position in which the lower target face extends downwardly and rearwardly when the upper target is in an upper target ready position. A rear stop surface on the upper shank contacts a stop bar on the lower shank free end and forces the lower target to pivot about the lower target pivot pin axis from the lower rest position to a lower target ready position in response to the upper target moving to the upper target moving to the horizontal position upon being struck by a bullet. The lower target pivots the upper target to the upper target ready position in response to being struck by a bullet.

BRIEF DESCRIPTION OF DRAWINGS

These and other objects, features and advantages of this invention will become readily apparent in view of the following detailed description of the preferred embodiments and best mode, appended claims and accompanying drawings, in which:

DETAILED DESCRIPTION OF THE PREFERRED EMBODIMENTS

Figure 1:
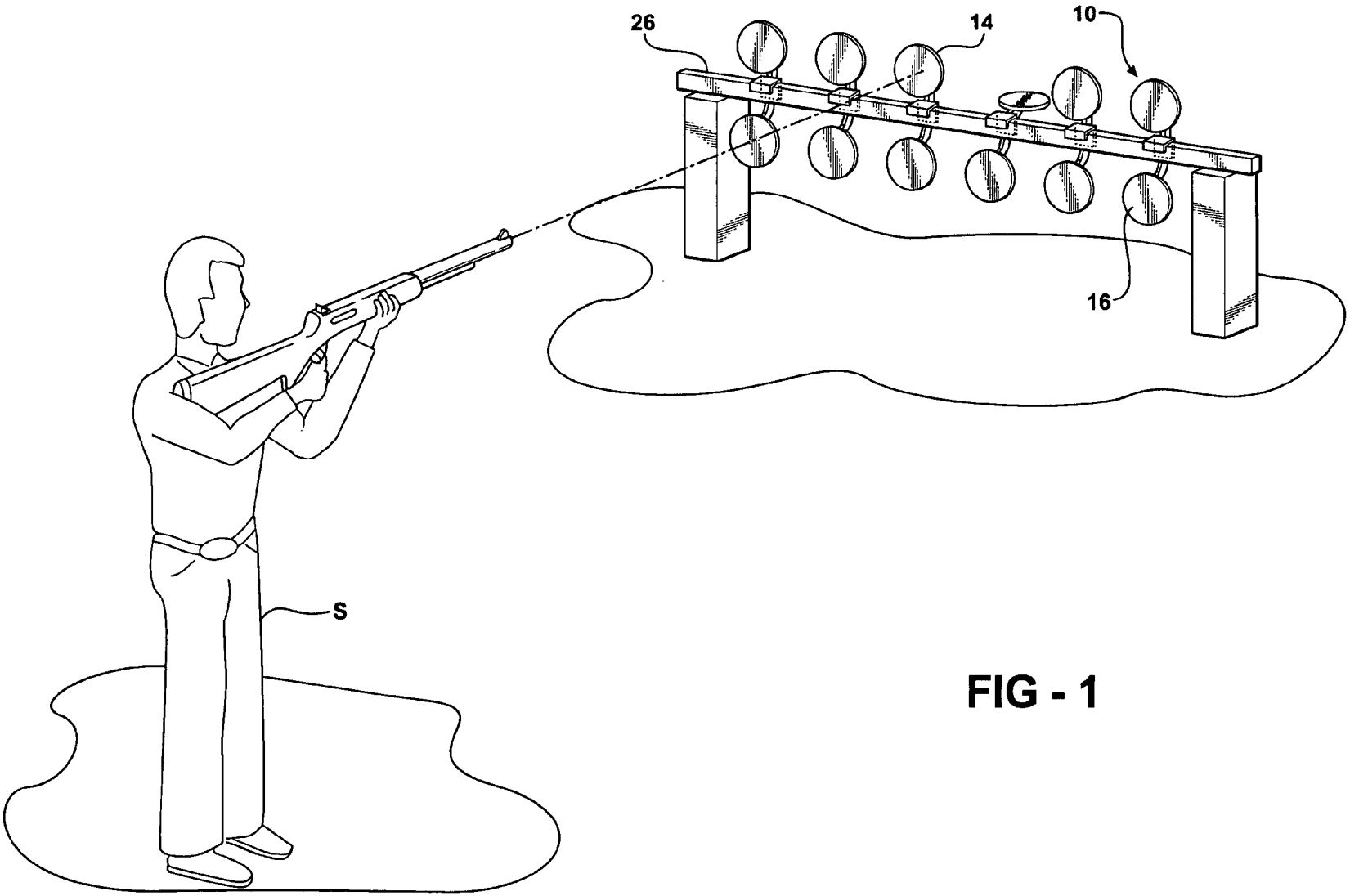
FIG. 1 is a perspective view of a plurality of firearm target assemblies mounted on one elongated horizontal beam.
Figure 2:
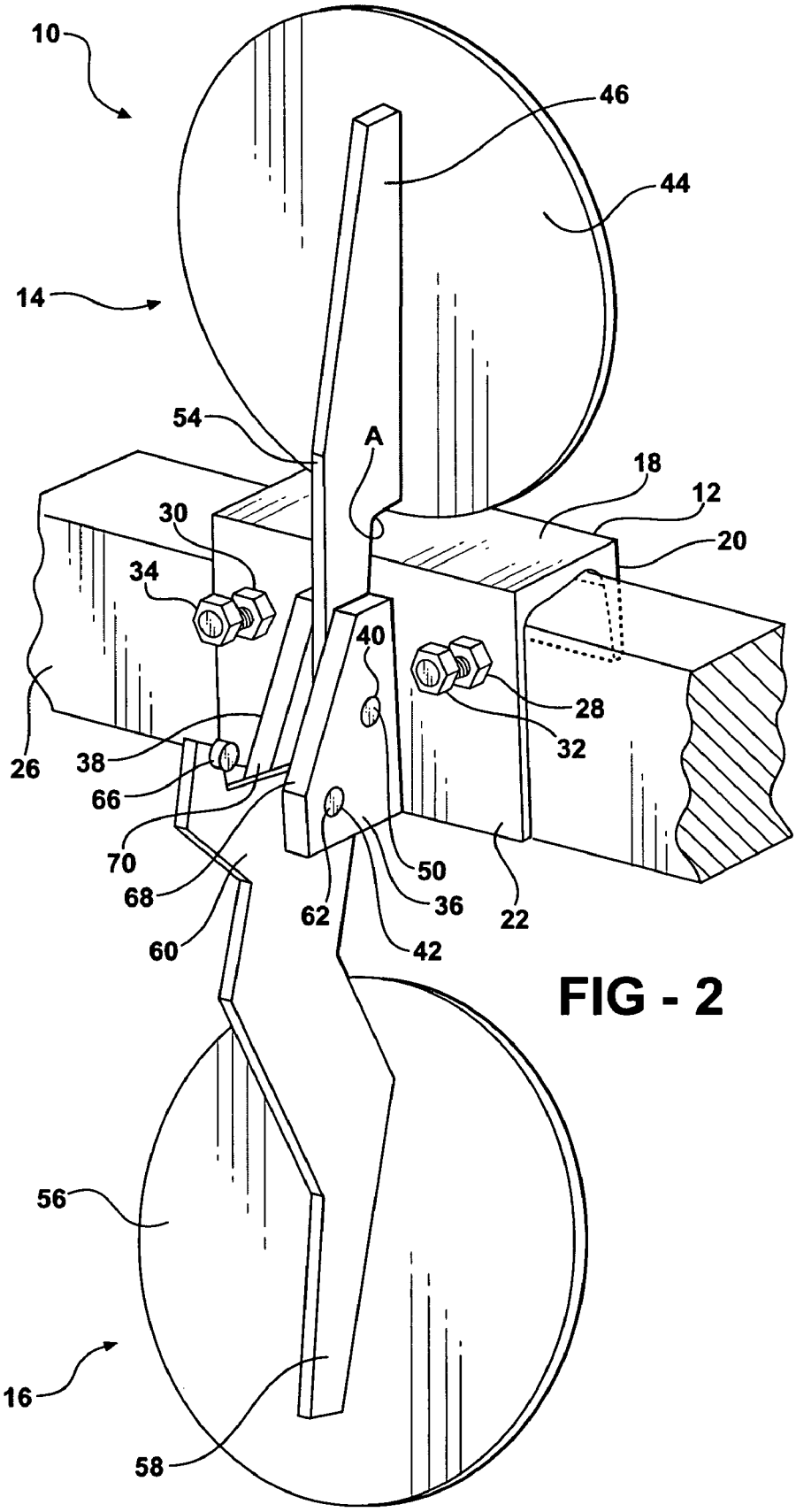
FIG. 2 is a perspective view of the rear of the firearm target assembly mounted on a horizontal beam with parts broken away and with the upper target plate in a generally vertical ready position.
Figure 3:
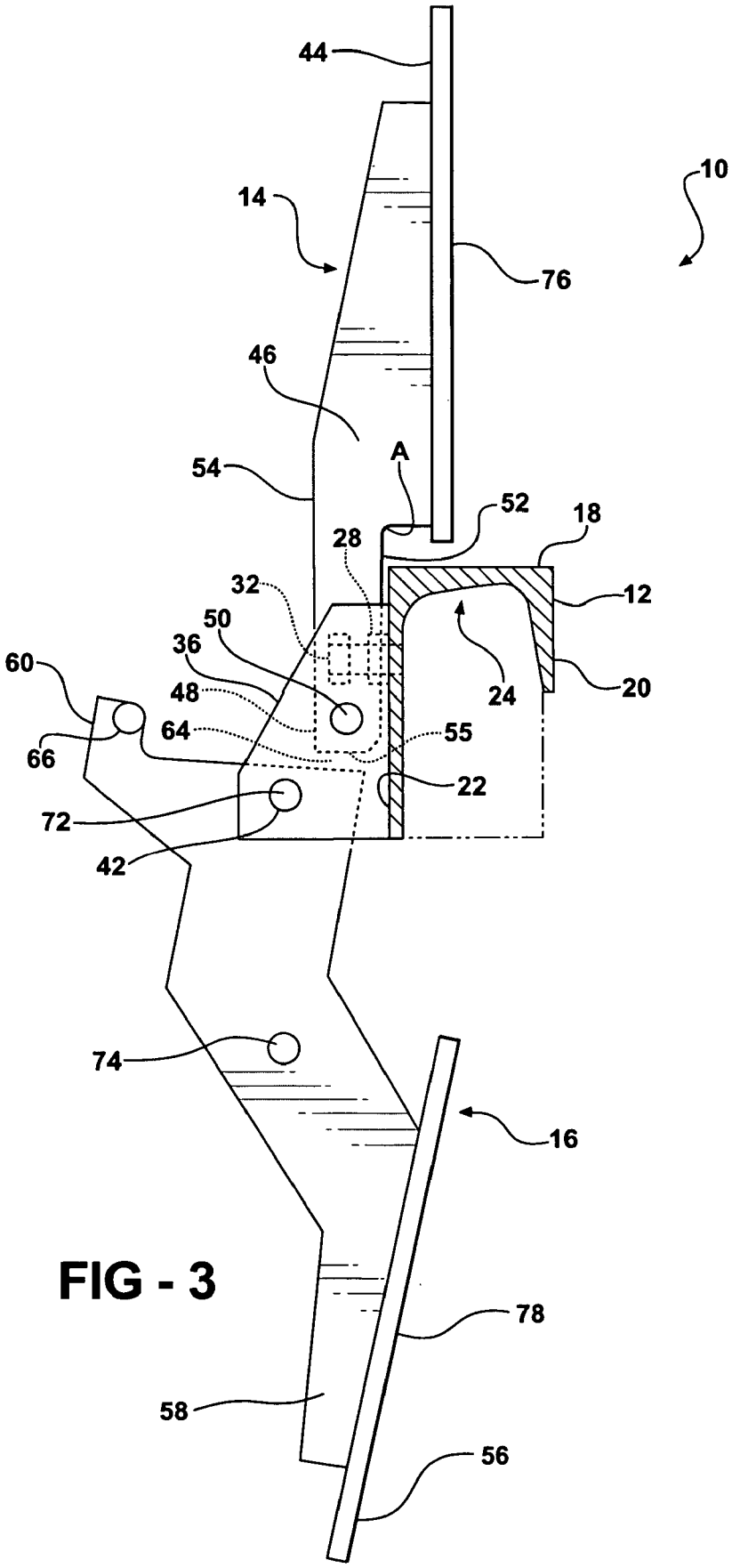
FIG. 3 is a side elevational view of the firearm target assembly with the upper target plate in a generally vertical ready position and the lower target in a rest position.

The firearm target assembly 10 includes a target mounting frame 12, an upper target assembly 14 and a lower target assembly 16. The target mounting frame 12 is a channel shaped member with a top frame wall 18, a front frame wall 20, and a rear frame wall 22. The channel 24 in the channel shaped member receives the upper edge of a two by six or a two by four wood beam 26. A pair of threaded nuts 28 and 30 are fixed to the outside of the rear frame wall 22. A bolt 32 screws into the threaded nut 28, extends through the rear frame wall 22 and forces the beam 26 toward the front frame wall 20. A bolt 34 screws into the threaded nut 30, extends though the rear frame wall 22 and forces the beam 26 toward the front frame wall 20. Tightening both bolts 32 and 34 clamps the target mounting frame 12 to the beam 26. The bolts 32 and 34 are preferably relative large in diameter and do not penetrate too far into the wood beam 26. If necessary a metal plate can be inserted between the bolts 32 and 34 and the wood beam 26 or a steel beam can be substituted for the wood beam 26. The mounting frame 12 can also be attached directly to the beam 26 by bolts. A pair of vertical spaced apart ears 36 and 38 are fixed to the rear frame wall 22. An upper pivot pin bore 40 is drilled through the ears 36 and 38. A lower pivot pin bore 42 is also drilled though the ears 36 and 38. The position of the upper pivot pin bore 40, the lower pin bore 42 and the rear frame wall 22 relative to each other is important to operation of the target assembly 10.

The upper target assembly 14 includes a flat metal target disk 44 fixed to an upper shank 46. The metal target disk 44 has sufficient thickness and strength to prevent penetration by a projectile and to minimize deforming. If the weights or velocity of the projectile increase, it may be necessary to increase the thickness of the target disk 44 to provide adequate strength. If the weight or velocity of the projectile decrease significantly, it may be necessary to decrease the thickness or diameter of the target disk 44 to obtain the desired operation of the upper target assembly. A fillet A shown in FIGS. 2, 3, 4 and 5 is provided to reduce stress and prevent crack formation in the upper shank 46.

The upper shank 46 of the upper target assembly 14, extends radially outward from the center of portion the target disk 44 to an upper shank free end 48. A shank pivot bore passes though the upper shank free end 48. The free end 48 of the upper shank 46 is positioned between the ears 36 and 38. An upper target pivot pin 50 passes through the upper pivot pin bore 40 through the ears 36 and 38 and through an upper shank pivot pin bore to pivotally attach the upper target assembly 14 to the mounting frame 12. The pivot pin 50 may be non-rotatable relative to the upper shank 46. The pivot pin 50 can also be a hardened steel bolt. If a bolt is used, the upper shank will rotate and the bolt will be fixed in the upper pivot pin bore 40. A front upper stop surface 52, on the upper shank 46, contacts the upper edge of the rear wall 22 of the target mounting frame 12 to limit pivotal movement of the upper target assembly 14 in one direction. A rear stop surface 54, on the upper shank 46 limits pivotal movement of the upper target assembly 14 in another direction as described below. The upper shank 46 also has a shank bottom stop surface 55 which is not normally used.

The lower target assembly 16 includes a flat metal target disk 56 fixed to a lower shank 58. The flat metal target disk 56 has sufficient thickness and strength to prevent penetration by a projectile and to minimize deforming. If the weight or velocity of the projectile increase, it may be necessary to increase the thickness of the target disk 56 to provide adequate strength. If the weight or velocity of the projectile decreases significantly, it may be necessary to decrease the thickness or diameter of the flat metal target disk 56 to obtain the desired operation of the lower target assembly 16.

Figure 5:
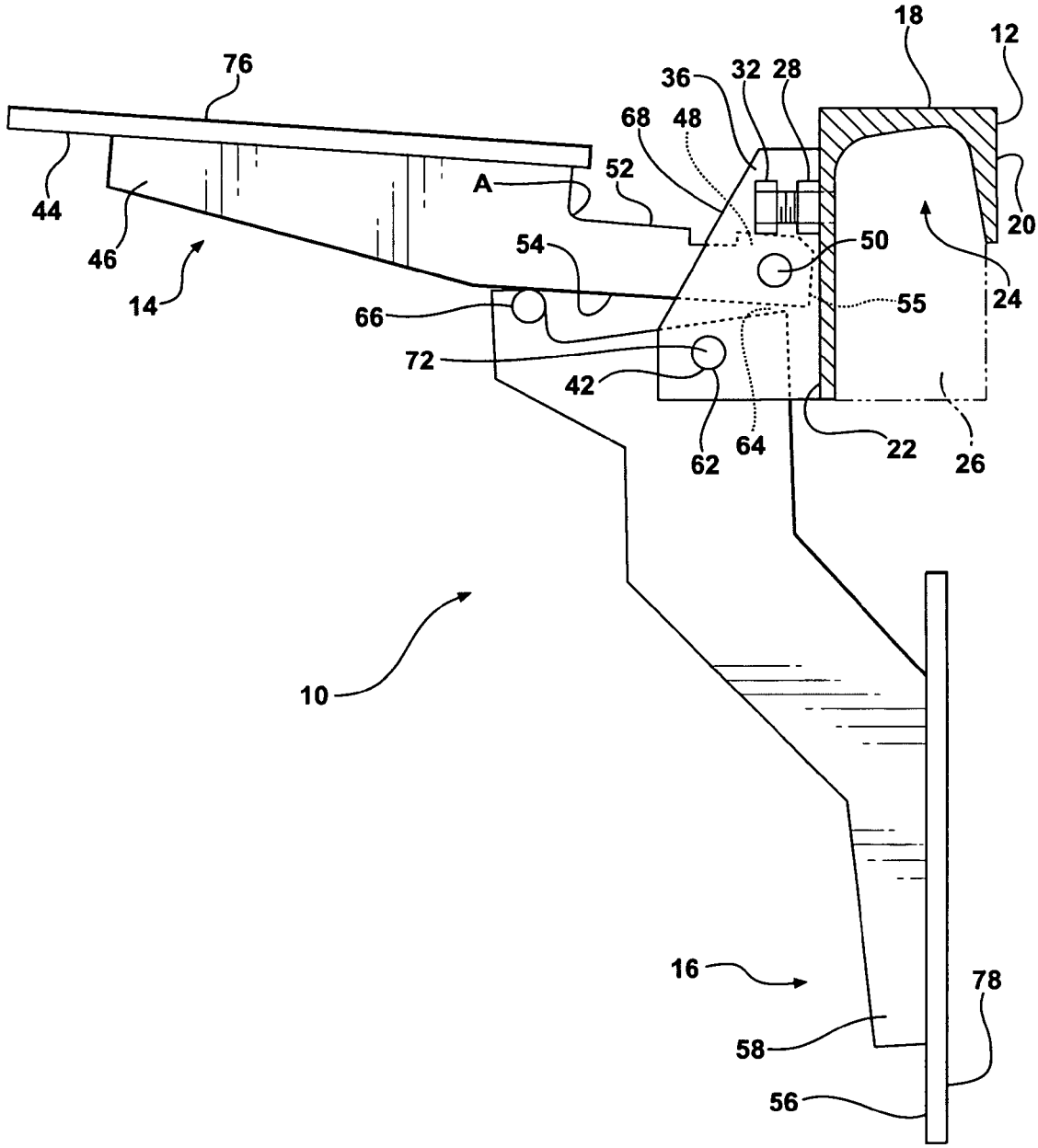
FIG. 5 is a side elevational view of the firearm target assembly with the lower target plate in a vertical ready position and the upper target plate holding the lower target plate in the vertical ready position.

The lower shank 58, of the lower target assembly 16, extends radially outward from the center portion of the target disk 56 to an upper shank free end 60. A shank pivot bore passes thought the lower shank free end 60. The free end 60 of the lower shank 58 is positioned between the ears 36 and 38. A lower target pivot pin 62 passes through the lower pivot pin bore 42 through the ears 36 and 38 and through a lower shank pivot pin bore to pivotally attach the lower target assembly 16 to the mounting frame 12. The pivot pin 62 may be non-rotatable relative to the lower shank 58. The pivot pin 62 can also be a hardened steel bolt. If a bolt is used, the lower shank 58 will rotate and the bolt will be fixed in the lower pivot pin bore. The stop surface 64 on the lower shank free end 60 engages the rear stop surface 54 to limit pivotal movement of the lower target assembly 16 in one direction when the upper target assembly 14 is in a horizontal position, as shown in FIG. 5. A stop bar 66 of hardened steel is fixed to the lower shank free end 60 and extends laterally from each side of the lower shank 58. The stop bar 66 contacts the inclined surfaces 68 and 70 on the ears 36 and 38 to limit pivotal movement of the lower target assembly 16 in a second direction about the axis 72 of the lower target pivot pin 62.

Figure 4:
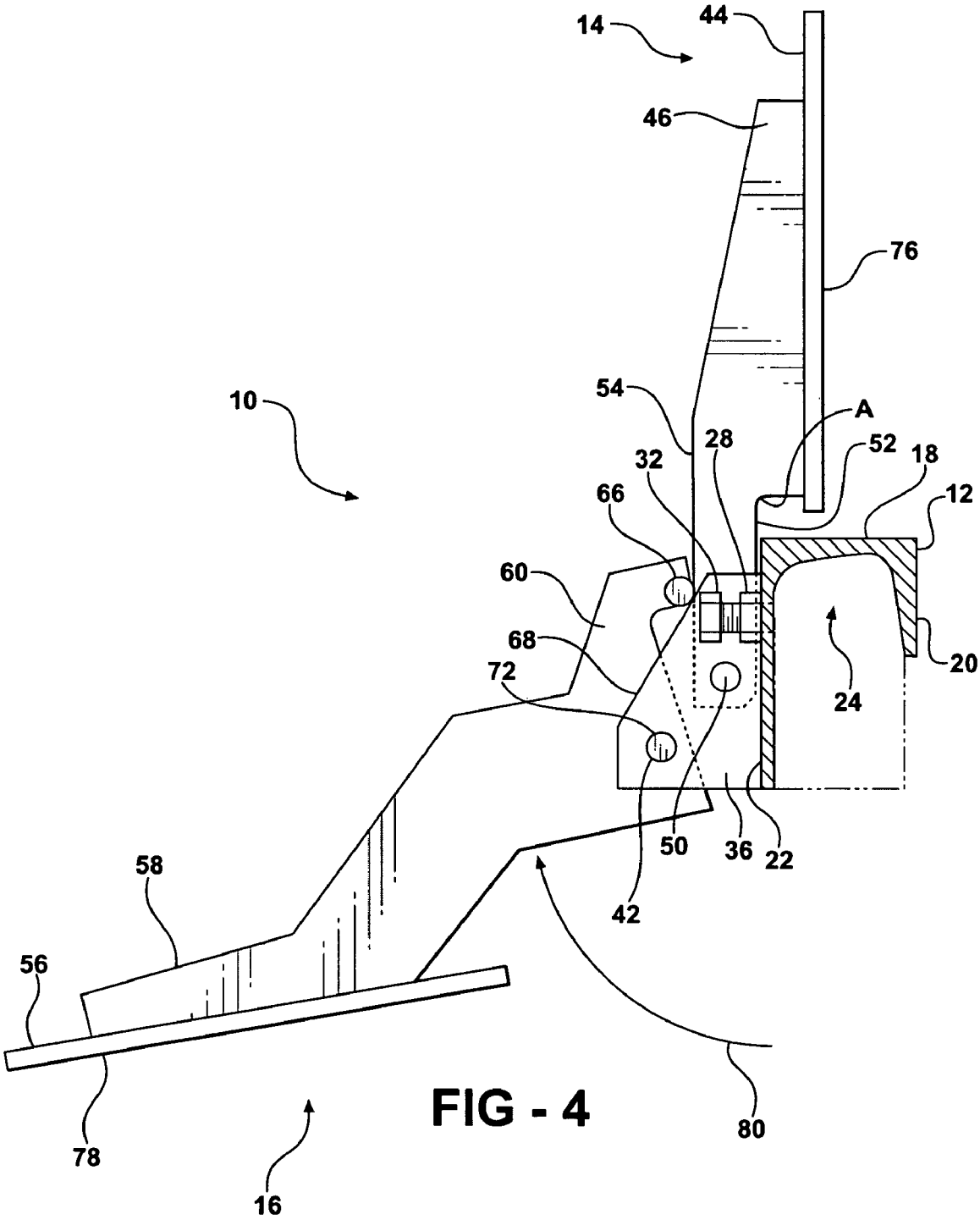
FIG. 4 is a side elevational view of the firearm target assembly with the upper target plate in the generally vertical ready position and with the lower target plate at the upper limit of its range of pivotal movement.

During target practice with a firearm, the firearm target assembly is clamped to a beam 26 by tightening the bolts 32 and 34 to clamp the target mounting frame 12 to the beam. The upper target assembly 14 is placed in the raised vertical position shown in FIGS. 2 & 3. The lower target assembly 16 is inclined downwardly and rearwardly placing the center of gravity 74 of the lower target assembly 16 directly below the axis 72 of the lower target pivot pin 62. In this position the lower target assembly 16 is still visible. However, the angle of the flat metal target disk 56 is moved sufficiently from vertical to be observed from a firing line. The upper flat metal target disk 44 is substantially vertical. The shooter has been instructed to fire at the top round target disk 44 if two targets disks 44 and 56 are visible. A projectile that strikes the front face 76 of the flat metal target disk 44 will pivot the upper target assembly 14 about the upper target pivot pin 50 and move the target disk rearward and downward to the position shown in FIG. 5. Pivotal movement of the upper target assembly 14 will stop when the stop surface 64 on the lower shank 58 contacts the rear stop surface 54 on the upper shank 46. The rear stop surface 54 on the upper shank 46 contacts the stop bar 66 on the lower shank free end of the lower shank 58 before pivotal movement upper target assembly 14 from the vertical position is stopped. The weight of the upper target assembly 14 exerts a force through the stop bar 66 that pivots the lowered target front disk front face 78 on the lower target assembly 16 to a generally vertical position, shown in FIG. 5 from the inclined position shown in FIG. 3. The lower target assembly 16 is in a ready position with the front face 78 of target disk 56 generally vertical and the upper target assembly 14 generally horizontal and below the top frame wall 18 as shown in FIG. 5. The shooter 5 can see the lower target assembly 16 but not the upper target assembly 14 from a firing line. The next projectile launched by the shooter 5 will strike the front face 78 of the target disk 56 and pivot the lower target assembly 16 about the axis 72 of lower target pivot pin 62 in the direction indicated by the arrow 80 in FIG. 4. The stop bar 66 on the lower shank 58 exerts force on the rear stop surface 54 and pivots the upper target assembly 14 about the axis of the upper target pivot pin 50. Pivotal movement of the lower target assembly 16 continues until the stop bar 66 contacts the inclined surfaces 68 and 70 on the ears 36 and 38 and further upward movement of the lower target assembly is blocked as shown in FIG. 4. Upon reaching the position shown in FIG. 4, the upper target assembly 14 is in a vertical ready position and gravity will pivot the lower target assembly 16 to the position shown in FIG. 3. Upon the upper and lower target assemblies 14 & 16 reaching the positions shown in FIG. 3, the firearm target assembly 10 is ready to start the cycle over.

Occasionally the projectile will not exert sufficient force to pivot the lower target assembly 16 from the ready position shown in FIG. 5 to the position shown in FIG. 4 due to low projectile weight or low projectile velocity. When there is a failure to lift the upper target assembly 14 to the position shown in FIG. 4, gravity will return the upper target assembly and the lower target assembly 16 to the position shown in FIG. 5.

The pivotal connections between the target pivot pins 50 and 62 and the respective target assemblies 14 and 16 are important to operation of the target assembly 10 the number of pivots is limited to two to minimize the effect of friction and wear on the target assembly. As explained above, the pivot pins 50 and 62 can be fixed to the respective upper shank 46 and the lower shank 58. This doubles the bearing area thereby decreasing the load and wear. An alternate construction could include bearing sleeves clamped between the ears 36 and 38 by bolts that replace the pivot pins 50 and 62. Washers can be used to insure that the shanks 46 and 58 do not contact the ears 36 and 38. Bearing seals can be employed to keep foreign matter out of contact with bearing surfaces.

A third possible pivotal connection between target assemblies 14 and 16 includes bolts in place of the pivot pins 50 and 62. Large diameter bolts would provide the same bearing surface as the bearing sleeves descriped above. Bending of the ears 36 and 38 could be prevented by employing a torque wrench to limit tightening of the nut. A bolt with a shoulder could also be used to eliminate bending loads on ears 36 and 38.

I claim:

1. A firearm target assembly comprising:

an elongated frame adapted to be secured to a target support;

at least one vertical ear fixed to the elongated frame member and extending rearwardly from the elongated frame, an upper pin bore through the vertical ear, and a lower pin bore through the vertical ear that is below and parallel to the upper pin bore, an upper target pivot pin mounted in the upper pin bore and having an upper pivot pin axis, and a lower target pivot pin mounted in the lower pin bore and having a lower pivot pin axis;

an upper target including an upper flat metal disk with an upper disk target face and an upper disk back, an upper shank secured to the upper disk back and extending outward from the upper flat metal disk and having an upper shank free end spaced from the upper flat metal disk and wherein the upper shank free end is secured to the upper target pivot pin for pivotal movement about the upper pivot pin axis;

a lower target including a lower flat metal disk with a lower disk target face and a lower disk back, a lower shank secured to the lower disk back and extending outward from the lower flat metal disk and having a lower shank free end and wherein the lower shank free end is secured to the lower target pivot pin for pivotal movement about the lower pivot pin axis;

a front upper stop surface on the upper shank that engages a mount stop surface on the elongated frame to hold the upper target in an upper target ready position with the upper disk target face in a substantially vertical position;

a rear stop surface on the upper shank that contacts a lower shank stop on the lower shank free end as the upper target pivots rearward, from the substantially vertical upper target ready position, and pivots the lower target to a lower target ready position in which the lower disk target face is in a substantially vertical lower target ready position; and wherein rearward pivotal movement of the lower target from the lower target ready position transmits force through the lower shank stop to the rear stop surface on the upper shank and pivots the upper target to the upper target ready position.

2. A firearm target assembly, as set forth in claim 1, wherein a lower target center of gravity holds the lower target in a lower target rest position with the lower disk target face facing downwardly and forwardly.

3. A firearm target assembly, as setforth in claim 1, wherein the lower shank stop on the lower shank free end is on a stop bar that is fixed to the lower shank.

4. A firearm target assembly, as set forth in claim 3, wherein the stop bar contacts the at least one ear fixed to the elongated frame member to limit rearward movement of the lower flat metal disk.

5. A firearm target assembly, as setforth in claim 1, wherein the at least one ear includes a first vertical ear fixed to the elongated frame, a second vertical ear parallel to and spaced from the first vertical ear and wherein the upper shank free end is held between the first vertical ear and the second vertical ear, and the lower shank free end is held between the first vertical ear and the second vertical ear.

6. A firearm target assembly comprising;

an elongated target mount including a top frame wall, a front frame wall integral with the top frame wall and a rear frame wall integral with the top frame wall forming a channel adapted to receive horizontal target supports;

a pair of threaded fastener mounted in the rear frame wall and advancable into the channel and toward the front frame wall to clamp the elongated target mount to supports;

a first vertical ear fixed to the rear frame and extending rearward from the rear frame wall and a second vertical ear parallel to and spaced from the first vertical ear;

an upper target including an upper flat metal disk and an upper disk back with an upper disk face an upper shank secured to the upper disk back of the flat metal disk and extending radially from the upper flat metal disk to an upper shank free end;

an upper target pivot pin extending through a first upper pin bore through the first vertical ear, through the upper shank free end and through a second upper pin bore through the second vertical ear and wherein the upper target pivot pin supports the upper target for pivotal movement about an upper horizontal axis between an upper target ready position in which the upper disk face is substantially vertical and a front upper stop surface on the upper shank engages a mount stop surface on the elongated target mount and a substantially horizontal position down range from the elongated target mount;

a lower target including a lower flat metal disk with a lower disk face and a lower disk back, a lower shank secured to the lower disk back and extending radially from the lower flat metal disk to a lower shank free end;

a lower target pivot pin extending through a first lower pin bore through the first vertical ear, through the lower shank free end and through a second lower pin bore through the second vertical ear and wherein the lower target pivot pin supports the lower target for pivotal movement about a lower horizontal axis that is parallel to the upper horizontal axis and below the upper horizontal axis and wherein the lower target is moved by gravity to a lower target rest position in which the lower target face extends downwardly and rearwardly when the upper target is in an upper target ready position;

a rear stop surface on the upper shank that contacts a stop bar on the lower shank free end and forces the lower target to pivot about the lower target pivot pin axis from the lower rest position to a lower target ready position in response to the upper target moving to the horizontal position upon being struck by a bullet; and wherein the lower target pivots the upper target to the upper target ready position in response to being struck by a bullet.

* * * * *